United States Patent [19]

Peterpaul

[11] 4,048,839

[45] Sept. 20, 1977

[54] DIE MEANS HAVING WORKPIECE RELEASING MEANS

[75] Inventor: Joseph Peterpaul, West Orange, N.J.

[73] Assignee: Thomas & Betts Corporation, Elizabeth, N.J.

[21] Appl. No.: 732,325

[22] Filed: Oct. 14, 1976

[51] Int. Cl.[2] ..... B21D 37/12

[52] U.S. Cl. ..... 72/412; 72/410; 29/753

[58] Field of Search ..... 72/412, 416, 384, 385, 72/410; 29/751, 753; 59/75

[56] References Cited

U.S. PATENT DOCUMENTS

| | | | |
|---|---|---|---|
| 3,245,246 | 4/1966 | Filson | 72/412 |
| 3,616,674 | 11/1971 | Piasecki et al. | 72/412 |

*Primary Examiner*—Lowell A. Larson

*Attorney, Agent, or Firm*—David Teschner; Jesse Woldman

[57] ABSTRACT

A die set comprising a pair of die members one ofwhich is provided with discretely mounted and independently laterally movable die elements cooperable with extending leg portions on the other die member to provide a variable opening die nest to assist in releasing a ferrule or similar article therefrom after the deforming operation.

12 Claims, 12 Drawing Figures

DIE MEANS HAVING WORKPIECE RELEASING MEANS

BACKGROUND OF THE INVENTION

1. Field of the Invention

The invention is directed to the field of die means for metal crimping and the like.

2. Description of the Prior Art

A problem generally encountered in prior art crimping dies involve the failure of such dies to provide a means for releasing a workpiece which has expanded under the compressive die forces and has become jammed in the die nest cavity. The operator is thus required to resort to a time consuming, laborious, and cumbersome manual operation to remove the jammed part from the die in preparation for a subsequent operation. One prior art device which has been designed to at least partially overcome this problem is disclosed in U.S. Pat. No. 3,616,674 issued on Nov. 2, 1971 to Piasecki et al and assigned to the assignee of the instant invention. The Piasecki device, although representing a significant improvement over other prior art devices and providing a generally simple, satisfactory solution to the problem, is relatively expensive to manufacture, requiring rather complex machining operations and critical tolerances.

SUMMARY OF THE INVENTION

The invention overcomes the limitations and difficulties noted above with respect to prior art devices by providing a compression die set which is less expensive and more versatile than such prior art devices, and which provides for the release of a workpiece in a simple, positive, and efficient manner. The invention includes a pair of mating die members, one of which is divided along a central axis into two discrete die elements each independently loosely coupled to a support member in such manner as to provide a central gap permitting lateral displacement of the die elements towards the central axis when acted upon by the upstanding leg portions of the other die member, and opposite movement away from the central axis when acted upon by the recovery forces of a compressed or crimped workpiece, the latter movement causing an enlargement of the die nest opening and consequent release of the workpiece as the die members are parted. Tapered external surfaces on the die elements are arranged to contact the inner surfaces of the leg portions of the opposing die member to smoothly urge the die elements towards one another as the die members are brought together. The die elements may be coupled to the support member by pins having a diameter somewhat smaller than the selectively dimensioned pin receiving openings in the die elements to provide controlled displacement of the die elements. Selective contouring of the pin receiving openings may be employed to control the direction and extent of the displacement of the die elements. It is therefore an object of this invention to provide an improved die set.

It is still a further object of this invention to eliminate the problem of workpiece jamming in a compression die set.

It is another object of this invention to provide an effective means for releasing a deformed workpiece from a compression die set.

It is a further object of this invention to provide a simple and inexpensive means for releasing a deformed workpiece from a compression die set.

It is still another object of this invention to provide a variable orifice die nest in a compression die set.

It is yet another object of this invention to provide an expandable die nest opening in a compression die.

Other objects and features will be pointed out in the following description and claims and illustrated in the accompanying drawings which disclose, by way of example, the principle of the invention and the best mode contemplated for carrying it out.

BRIEF DESCRIPTION OF THE DRAWINGS

In the Drawings

Similar elements are given similar reference characters in each of the respective drawings.

DESCRIPTION OF THE PREFERRED EMBODIMENTS

Figure 1:
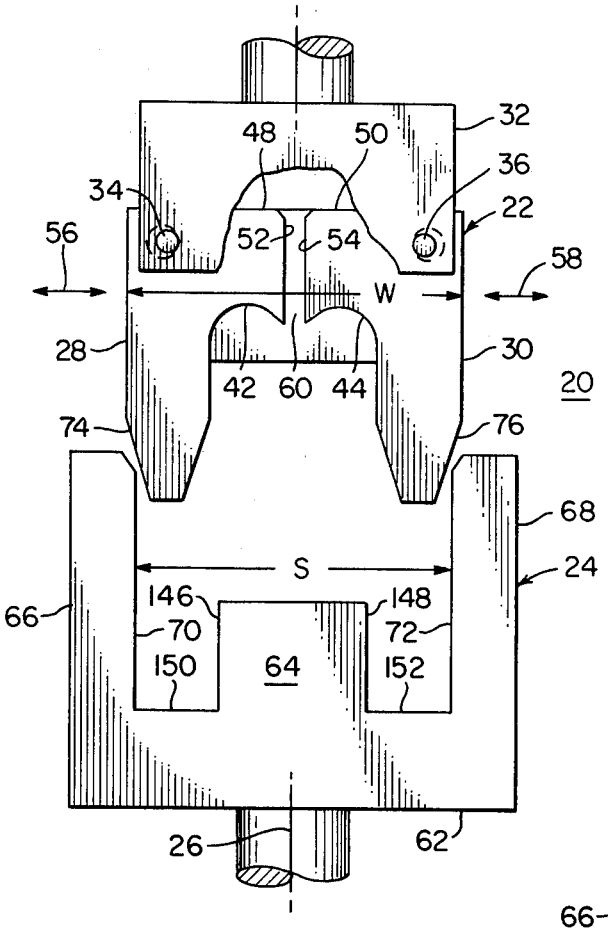
FIG. 1 is a front elevational view, partly cut away, of a die set constructed in accordance with the concepts of the invention.
Figure 2:
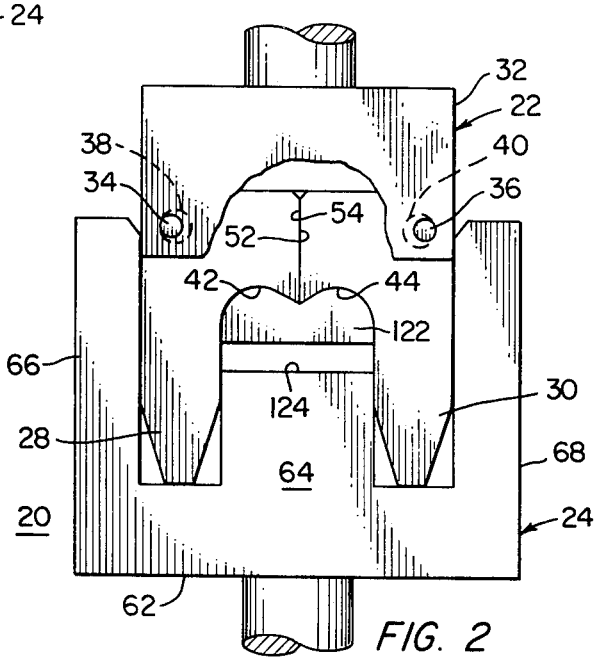
FIG. 2 is a front elevational view, partly cut away, showing the device of FIG. 1 in a closed state.
Figure 3:
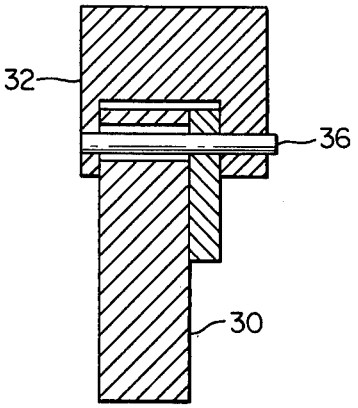
FIG. 3 is a side elevational view, in section, of a portion of the die set of FIG. 1.
Figure 4:
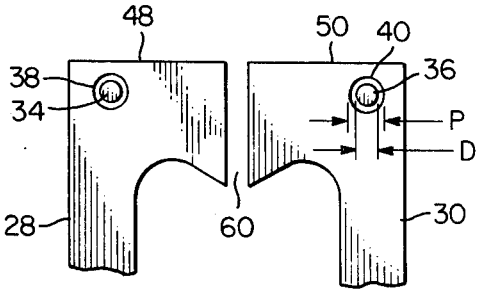
FIG. 4 is a fragmentary front elevational view, partly in section, in which the support member has been removed to better show further details of the die elements of the die set of FIG. 1.
Figure 5:
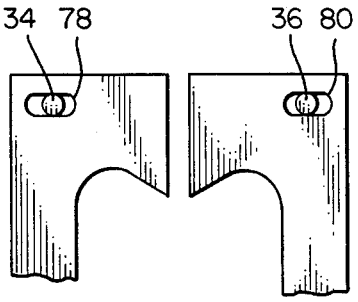
FIG. 5 is a fragmentary front elevational view, partly in section, showing a further embodiment of the coupling arrangement of a portion of a die set constructed in accordance with the concepts of the invention.
Figure 6:
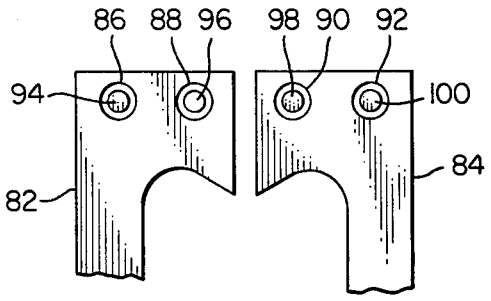
FIGS. 6 and 7 are fragmentary front elevational views, partly in section, showing still further embodiments of a portion of a die set constructed in accordance with the concepts of the invention.
Figure 8:
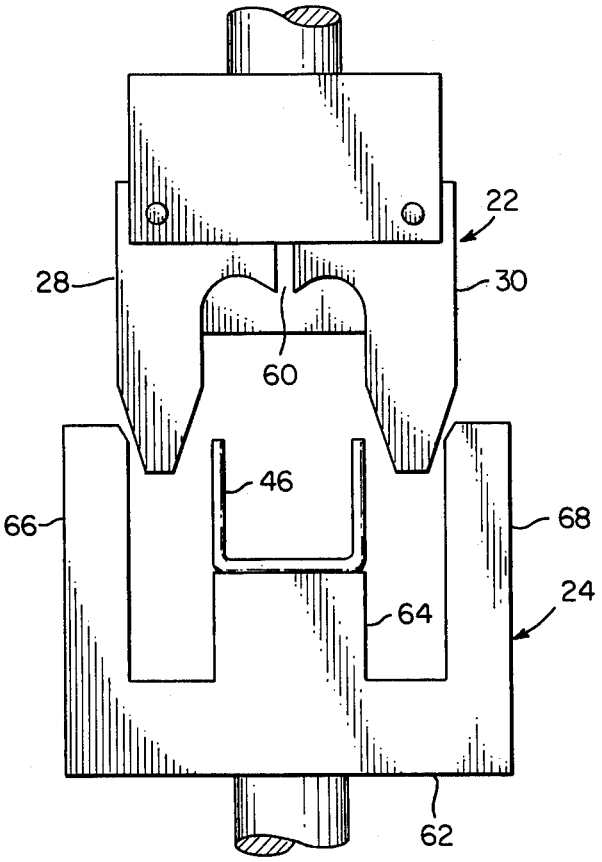
FIG. 8 is a front elevational view, partly cut away, showing a section of a workpiece positioned on the anvil portion of the device of FIG. 1.
Figure 7:
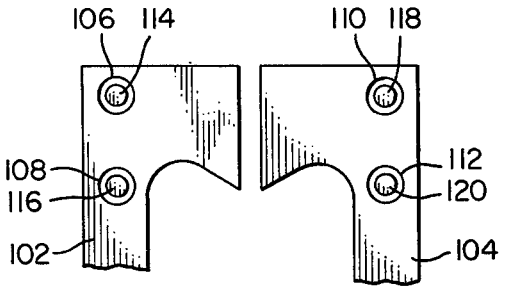

Turning now to FIGS. 1, 2, 3, 8, 9, 10, and 11, there is shown a die set 20 constructed in accordance with the concepts of the invention and comprising a pair of mating die members 22 and 24 movable towards and away from one another along a central axis 26. It will, of course, be readily apparent to those skilled in the art that the members 22 and 24 may be attached to any suitable drive means (not shown) which may, for example, be either manually, pneumatically, or hydraulically powered to provide the necessary movement of the die members 22 and 24. It should also be understood that the die set 20 may be oriented in any suitable position relative to a vertical or horizontal axis, and that the relative positions of the die members 22 and 24, may be reversed from that shown in the drawings. For example, the entire die set 20 may be reversed so that the die member 22 is the lower member and the die member 24 is the upper member. The die member 22 comprises a pair of die elements 28 and 30 each independently attached to a support means 32 by coupling means shown as pins 34 and 36, respectively, the die elements 28 and 30 each having a respective pin receiving opening 39, 40, (FIG. 2) slightly larger than a respective pin 34, 36, to provide a controlled degree of movement therebetween. Each of the die elements 28 and 30 comprises a contoured inner surface 42, 44, respectively, which, in combination, define a portion of a die nest for receiving and selectively deforming a workpiece such as 46 (FIG. 8). The die elements 28 and 30 each comprise a respective shoulder portion 48, 50, which terminates in a respective planar surface 52, 54. Due to the clearance between the pins 34 and 36 and the respective openings 38 and 40, each of the die elements 28 and 30 is free to move laterally in the directions of the arrows 56 and 58, respectively, from a first separated position substantially as shown in FIG. 1 in which there exists a gap 60 between the surfaces 52 and 54, to a second position in which the surfaces 52 and 54 substantially abut one another, as shown in FIG. 2. To insure that the die elements 28 and 30 are free to move towards one another into an abutting position, the total lateral clearance between each of the pins 34 and 36, and a respective die element opening 38, 40, as determined by the difference between the pin diameter D (FIG. 4) and the opening diameter P (FIG. 4), should be greater than the maximum width of the gap 60. This may be accomplished simply by controlling the pinopening clearance and the spacing between the pins 34 and 36. Returning now to FIG. 1, the die member 24 comprises a base portion 62, a central anvil portion 64 situated on the base portion 62, and a pair of spaced leg portions 66 and 68 extending upwardly from the base portion 62 and flanking the anvil portion 64. The leg portions 66 and 68 each comprise a preferably smooth planar inner surface 70, 72, respectively. The die elements 28 and 30 are each provided with a respective tapered exterior surface 74, 76, arranged to bear against a respective interior surface 70, 72 of the leg portions 66 and 68 to cause an inward displacement of the die elements 28 and 30 towards the central axis 26 as the die members 22 and 24 are brought together. To achieve the desired inward displacement of the die elements 28 and 30, the fixed internal spacing S between the interior surfaces 70 and 72 is chosen to be less than the maximum width W of the die elements 28 and 30 as measured laterally thereacross when the die elements 28 and 30 are displaced to their maximum spaced apart position. It should be understood that, prior to the initiation of the compression cycle, and while the die members 22 and 24 are in a disengaged or non-mating position, the die elements 28 and 30 may assume any position within the range of movement afforded by the gap clearance 60. Thus, where the die elements 26 and 28 are initially positioned in an abutting relationship prior to the initiation of the compression stroke of the tool or other device (not shown) to which the die members 22 and 24 may be attached, the tapered surfaces 74 and 76 will clear the inner surfaces 70 and 72 of the leg portions 66 and 68, the surfaces 70 and 72 thus operating merely to embrace the sides of the die elements 28 and 30 and maintain the elements 28 and 30 in abutting relationship, substantially as shown in FIG. 2. Where necessary or desirable, the openings 38 and 40 may be modified as shown at 78 and 80 in FIG. 5 to provide elongated slots restricting the movement of the die elements 28 and 30 in the direction of the central axis 26 while allowing free lateral movement within a given range governed by the length of the slots 78 and 80. In either case, however, the die elements 28 and 30 are free to pivot somewhat about the pins 34 and 36. Where it is either necessary or desirable to more closely restrict the movement of the die elements 28 and 30, the embodiments shown in FIGS. 6 and 7 may be employed. In FIG. 6 there are shown die elements 82 and 84 each of which is provided with a pair of pin receiving openings 86,88, and 90,92, respectively, essentially duplicative of openings 38 and 40, and aligned generally along an axis perpendicular to a central longitudinal axis corresponding to the axis 26 shown in FIG. 1, the die elements 82 and 84 being coupled to a support means such as 32 by pin means 94, 96, 98, and 100. In FIG. 7 there are shown die elements 102 and 104, each of which is provided with a pair of pin receiving openings 106, 108, and 110, 112, respectively, and mating pin means 114, 116, and 118, 120, respectively, the pair of openings 106 and 108, and the pair of openings 110 and 112 each being aligned along an axis parallel to a central longitudinal axis corresponding to axis 26 shown in FIG. 1. In either of the embodiments shown in FIGS. 6 and 7, the pin receiving openings are essentially circular, in cross section, but may comprise elongate slots such as shown in FIG. 5 at 78 and 80. Returning now to FIG. 2, the die members 22 and 24 are shown in a closed state wherein the die elements 28 and 38 have been urged towards one another upon their entry between the leg portions 66 and 68 of the die member 24. The gap 60 has been closed and the surfaces 52 and 54 positioned in abutting relationship. There is thus formed a closed die nest 122 comprising the surfaces 42 and 44 of the die elements 28 and 30, respectively, and an upper surface 124 on the anvil portion 64.

Figure 9:
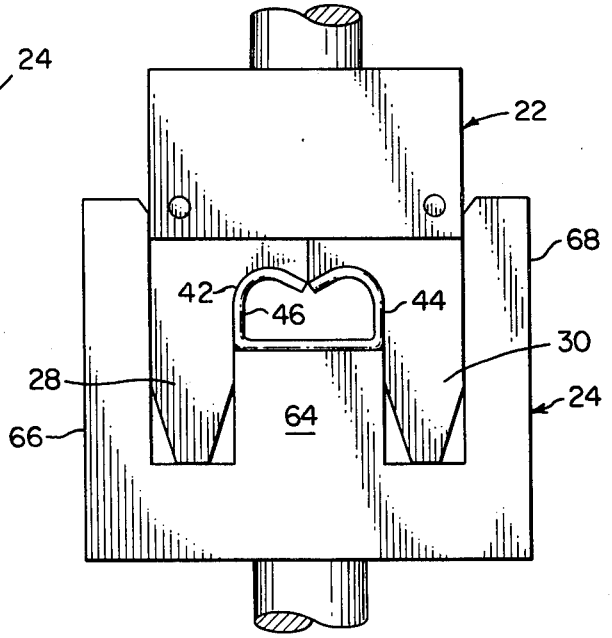
FIG. 9 is a front elevational view, partly cut away, showing a section of a workpiece operated on by the device of FIG. 1.
Figure 10:
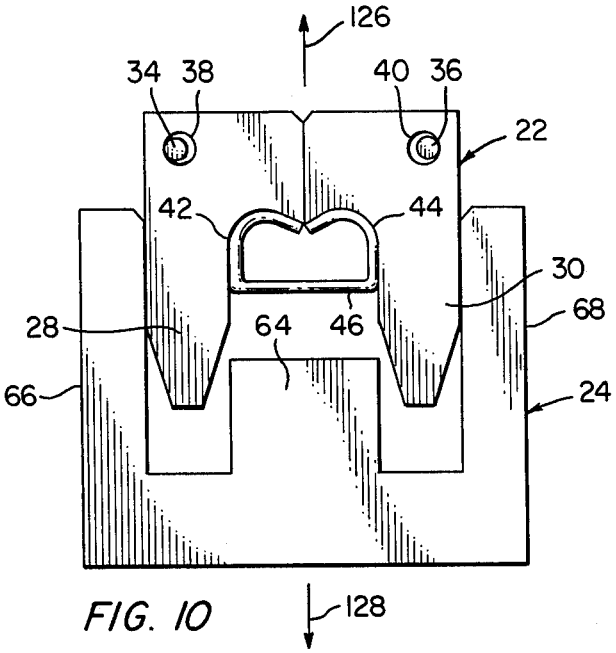
FIG. 10 is a fragmentary front elevational view, partly in section, showing a section of a deformed workpiece being held in the die nest of the device of FIG. 1 prior to release.
Figure 11:
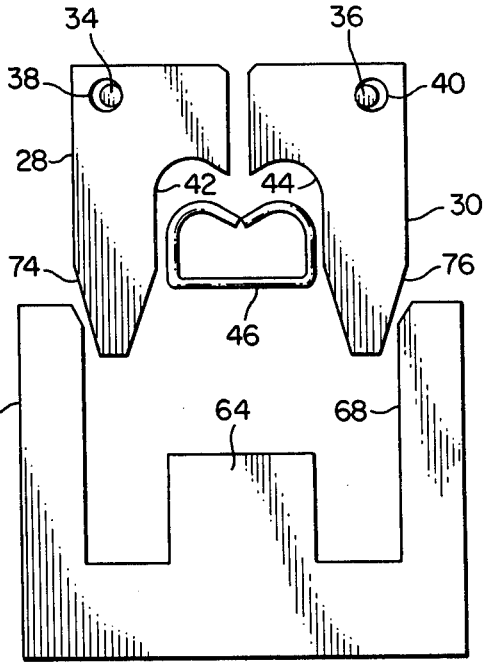
FIG. 11 is a front elevational view, partly in section, showing a section of a deformed workpiece being released from the die nest of the device of FIG. 1 upon completion of the operating cycle.

Turning now to FIG. 8 the die members 22 and 24 are shown in a parted or open state with the workpiece 46 positioned on the anvil portion 64. As the die members 22 and 24 are brought together, the die elements 28 and 30 of the first die member are urged laterally inwardly, closing the gap 60 and providing a closed die nest for compressively deforming the workpiece 46. At the completion of the compression stroke, as illustrated in FIG. 9, the workpiece 46 has been suitably deformed in accordance with the configuration of the die nest 122 (FIG. 2). It should also be appreciated that, for the sake of simplicity, the workpiece 46 is shown as containing no further article therewithin, although, in the conventional crimping operation, one or more elongate members such as electrical conductors or the like (not shown) may be seated within the workpiece 46 and the assembly thereafter subjected to a compressive force, as shown, to provide an electrical joint thereat. However, due to the inherent resiliency possessed by most metals, a metallic part such as 46, when subjected to a compressive force, tends to expand slightly after the compressive force is removed. In the case of the workpiece 46, this characteristic tends to cause the sides thereof to bear against the inner surfaces 42 and 44 of the die elements 28 and 30. In the case where one or more electrical conductors are contained within the workpiece 46, the recovery forces exerted by such conductors tend to add to those of the workpiece 46 to increase the above described expansion. Thus, as the die members 22 and 24 are moved apart in the directions shown by the arrows 126 and 128, respectively, but while the die elements 28 and 30 are still engaged by the leg portions 66 and 68, the expanding force existing in the workpiece 46 tends to cause it to be locked or jammed against the inner surfaces 42 and 44 of the respective die elements 28 and 30, instead of remaining on the anvil portion 64 for subsequent removal. However, as the die member 22 is moved away sufficiently from the die member 24 to cause the die elements 28 and 30 to clear the leg portions 66 and 68, as shown in FIG. 11, the elements 28 and 30 are free to move apart under the influence of the expanding force generated by the workpiece 46, thus releasing the workpiece 46 from between the surfaces 42 and 44. The release may be chosen to occur at any designated point in the opening cycle of the operation by suitably controlling either the length of leg portions 66 and 68, or the angle of taper of the tapered surfaces 74 and 76, or both. It will of course be appreciated that the arrangement shown for coupling the die elements 28 and 30 to the support member 32 may be reversed, that is, the die elements 28 and 30 may each be provided with pins such as 34 and 36, and the support member 32 provided with cooperating pin receiving openings such as 38 and 40 without departing from the spirit of the invention and within the concepts herein disclosed. It will be further appreciated that the particular die nest configuration illustrated herein is shown primarily for the sake of convenience, and that other die nest configurations appropriate for the deformation desired may be utilized in a similar manner.

Figure 12:
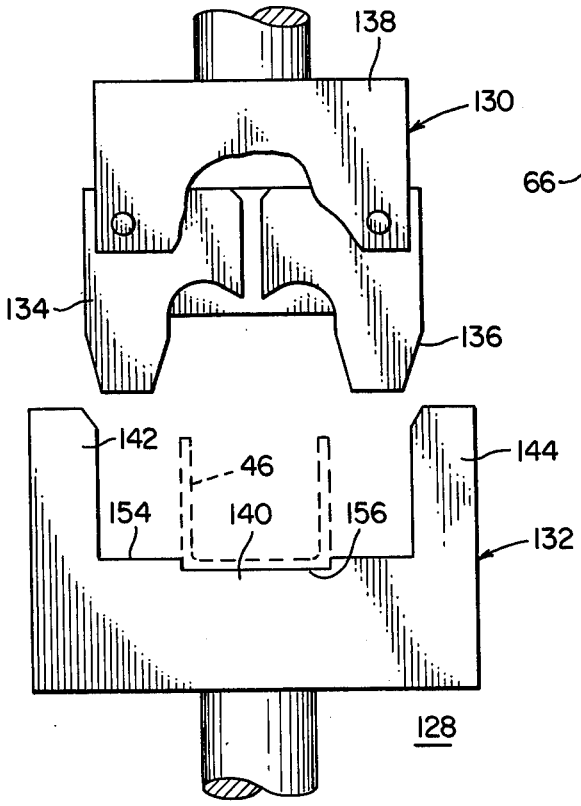
FIG. 12 is a front elevational view, partly cut away showing a further embodiment of a die set constructed in accordance with the concepts of the invention.

Referring now to FIG. 12, there is shown a further embodiment of a die set 128 constructed in accordance with the concepts of the invention and comprising a pair of mating die members 130 and 132. Die member 130 comprises a pair of independently movable die elements 134 and 136 essentially similar to elements 28 and 30, and similarly coupled to a support member 138 corresponding to support member 32 of die set 20. The die member 132 differs from die member 24, however, in comprising an anvil portion 140 which, rather than being confined in width and having side surfaces 146 and 148 separated from a pair of flanking leg portions 142 and 144 by recessed portions such as 150 and 152 (FIG. 1), is extended in width to provide an enlarged upper surface 154 in which is provided a recess 156 for positioning the workpiece 46.

The embodiments of the invention in which an exclusive property or privilege is claimed are defined as follows:

1. A die set for selectively deforming a ferrule or similar article comprising: a first die member and a second die member; said first and said second die members being arranged for movement towards and away from one another along a central axis; said first die member having a first discrete die element, a second discrete die element, a support means, a first pin member loosely coupling said first die element to said support means, and a second pin member loosely coupling said second die element to said support means, said first and said second die elements being arranged in juxtaposed relationship on opposite sides of said central axis and moveable towards and away from said central axis along a common plane, said first and said second pin members each extending through a respective enlarged transverse opening in a respective one of said first and said second die elements and engaging said support means, the diameter of said transverse openings being sufficiently greater than the diameter of said pin members so as to permit each of said first and said second die elements to freely float thereabout; said second die member having a central anvil portion flanked by opposing leg portions selectively spaced apart to receive therebetween said first and said second die elements of said first die member and to move said first and said second die elements towards one another adjacent said central axis as said first and said second die members are brought together in mating relationship.

2. A die set as defined in claim 1 wherein each of said first and said second die elements of said first die member comprises a tapered outer surface portion for abutting relationship with and adjacent inner surface of a respective leg portion of said second die member to cause said first and said second die elements to be urged together as said first and said second die members are brought together in mating relationship.

3. A die set as defined in claim 1 wherein said support means comprises a recessed portion for receiving a portion of said first and said second die elements therewithin.

4. A die set as defined in claim 1 wherein said first and said second die elements are each provided with a shoulder portion, said shoulder portions each having a generally planar surface, said surfaces located in close proximity to one another and arranged to abut one another as said first and said second die elements are urged together.

5. A die set as defined in claim 4 wherein each of said surfaces of said shouder portions is oriented generally parallel to said central axis.

6. A die set as defined in claim 1 wherein said first and said second die elements are substantially identical.

7. A die set as defined in claim 6 wherein the internal spacing between said leg portions of said second die member is less than the maximum lateral dimension as measured across said first and said second die elements as said first and said second die elements are positioned in maximum spaced apart relationship.

8. A die set as defined in claim 6 wherein the internal spacing between said leg portions of said second die is substantially equal to the minimum lateral dimension as measured across said first and said second die elements as said first and said second die elements are positioned in minimum spaced relationship.

9. A die set as defined in claim 8, there being recessed portions on either side of said anvil portion of said second die member, each of said recessed portions being located intermediate said anvil portion and a respective one of said leg portions of said second die member, said recessed portions each receiving a selective portion of a respective one of said first and said second die elements as said first and said second die members are brought together in mating relationship.

10. A die set as defined in claim 9 wherein said selective portion of each of said first and said second die elements comprises a tapered extension.

11. A die set as defined in claim 1 wherein said support means comprises a generally U-shaped interior channel having a generally planar base surface, each of said die elements having a further planar surface abutting said base surface of said interior channel to restrict the movement of each of said die elements substantially along an axis perpendicular to said central axis.

12. A die set as defined in claim 1 wherein the clearance between a respective one of said first and said second pin members and a respective transverse opening in each of said die elements is of sufficient magnitude so as to permit said respective planar surfaces on each of said shoulder portions to contact one another as said die elements are urged together.

* * * * *